US009649740B1

(12) United States Patent
Ting et al.

(10) Patent No.: US 9,649,740 B1
(45) Date of Patent: May 16, 2017

(54) VIBRATION ASSISTANT POLISHING MODULE

(71) Applicant: Industrial Technology Research Institute, Hsin-Chu (TW)

(72) Inventors: Chia-Jen Ting, Hsinchu County (TW); Tsung-Hsin Lin, Hsinchu County (TW); Ta-Hsin Chou, Hsinchu (TW); Chun-Fa Lan, Hsinchu (TW)

(73) Assignee: INDUSTRIAL TECHNOLOGY RESEARCH INSTITUTE, Hsin-chu (TW)

( * ) Notice: Subject to any disclaimer, the term of this patent is extended or adjusted under 35 U.S.C. 154(b) by 0 days.

(21) Appl. No.: 14/976,051

(22) Filed: Dec. 21, 2015

(30) Foreign Application Priority Data

Nov. 3, 2015 (TW) ..... 104136176 A

(51) Int. Cl.
*B24B 37/20* (2012.01)

(52) U.S. Cl.
CPC ..... *B24B 37/20* (2013.01)

(58) Field of Classification Search
CPC ..... B24B 37/20; B24B 37/12; B24B 37/30; B24B 41/06; H01L 21/68764
USPC ..... 451/212, 285–292
See application file for complete search history.

(56) References Cited

U.S. PATENT DOCUMENTS 5,643,053 A * 7/1997 Shendon ..... B24B 37/042 451/28
5,816,899 A * 10/1998 Hart ..... B24B 41/06 269/71
5,851,136 A 12/1998 Lee
(Continued)

FOREIGN PATENT DOCUMENTS

CN 100553835 C 10/2009
CN 103817563 A 5/2014
(Continued)

OTHER PUBLICATIONS

Tsung-Huan Li, "A study on Ultrasonic Assisted Polishing on hard and brittle materials", 2005, National Digital Library of Theses and Dissertations in Taiwan.
(Continued)

*Primary Examiner* — Larry E Waggle, Jr.
*Assistant Examiner* — Henry Hong
(74) *Attorney, Agent, or Firm* — WPAT, PC; Justin King

(57) ABSTRACT

A vibration assistant polishing module which comprises a polishing disk, a workpiece carrier tray, a linear guide way mechanism, a linkage, a motor and an adjustable eccentricity mechanism. The linear guide way mechanism includes a slide, a guide seat and a guide rod. The slide is pivot jointed with workpiece carrier tray and engaged in guide seat. The adjustable eccentricity mechanism comprises a base which is connected with a power shaft of the motor, and a pivot shaft of base and linkage is eccentric to the power shaft. The power shaft drives the base rotating and the linkage swinging eccentrically, and the slide moves linearly according to the limitation from guide seat, and a horizontal radial vibration and low frequency vibration is generated on the workpiece carrier tray, so the low frequency vibration is generated on the surface of the workpiece which is touched with the polishing disk.

9 Claims, 7 Drawing Sheets

(56) References Cited

U.S. PATENT DOCUMENTS

| | | | | |
|---|---|---|---|---|
| 5,934,979 | A * | 8/1999 | Talieh | B24B 21/004 451/271 |
| 6,413,156 | B1 * | 7/2002 | Shimizu | B08B 1/04 257/E21.23 |
| 6,428,397 | B1 | 8/2002 | Stocker | |
| 6,520,843 | B1 * | 2/2003 | Halley | B24B 9/065 451/285 |
| 6,864,181 | B2 | 3/2005 | Redeker et al. | |
| 7,692,360 | B2 | 4/2010 | Liu et al. | |
| 8,814,635 | B2 | 8/2014 | Hosokai et al. | |
| 2002/0132561 | A1 * | 9/2002 | Schulz | B24B 37/12 451/41 |
| 2005/0042861 | A1 | 2/2005 | Redeker et al. | |

FOREIGN PATENT DOCUMENTS

| | | |
|---|---|---|
| CN | 203636513 U | 6/2014 |
| JP | 2006-75986 A | 3/2006 |
| TW | 457578 | 10/2001 |
| TW | I275442 | 3/2007 |
| TW | M358030 | 6/2009 |
| TW | M400382 | 3/2011 |
| WO | WO2006022592 A1 | 3/2006 |

OTHER PUBLICATIONS

Yang, et al. "Ultrasonic Vibration Assisted Machining Study for Glass Processing", Mar. 2010, pp. 64-74, National Kaohsiung University of Applied Sciences, ISSN 1813-3851.

Zhang et al. "Grinding Wheel Loading with and without Vibration Assistance", Oct. 23, 2014, Michigan Technological University, Houghton, MI, USA.

Zhang et al. "Wheel Loading Reduction with Vibration Assisted Grinding", Jan. 2007, Department of Mechanical Engineering-Engineering Mechanics Michigan Technological University, Houghton, Michigan, USA.

Fess et al. "Ultrasonic Processing of Hard Materials for Conformal Optics", Apr. 29, 2013, OptiPro Systems, 6368 Dean Parkway, Ontario, New York USA 14519.

Liao et al. "Ultrasonic Vibration Assisted Mechanical chemical polishing (MCP) of Silicon Carbide", Sep. 2014, Journal of the Mechatronic Industry. Hsinchu, Taiwan ROC.

* cited by examiner

VIBRATION ASSISTANT POLISHING MODULE

CROSS REFERENCE TO RELATED APPLICATION

This application also claims priority to Taiwan Patent Application No. 104136176 filed in the Taiwan Patent Office on Nov. 3, 2015, the entire content of which is incorporated herein by reference.

TECHNICAL FIELD

The present disclosure relates to a vibration assistant polishing module, and more particularly, to a vibration assistant polishing module capable of using the cooperative operation of an adjustable eccentricity mechanism and a linear guide way mechanism as a low-frequency vibration source.

BACKGROUND

For the machining of those hard-brittle substrates, such as sapphire wafers and SiC wafers, a polishing process can be essential.

Globally, there are about 40% of energy is being converted into electric power to be consumed, while it is known that the largest waste in the electric energy conversion happens in the semiconductor power components. Generally speaking, the silicon power components, that was once the most essential and mainstream in today's industrial society, had reached the material limit and can no longer fulfill the requirements in today's social development for demanding high frequency, high temperture, high power, high performance, high environmental resistance, light-weight and miniaturization. On the other hand, the SiC is advantageous in its wide energy band gap, excellent thermal conductivity and supreme chemical stability that it is suitable for making high-power high-temperature semiconductor components. Thus, the third generation semiconductors, such as the SiC semiconductor components, are designed with excellent semiconductor properties and are commonly used in almost every modern industrial field today with revolutionary effect, including photoelectronic devices and power electronic devices. The third generation semiconductors are expected to have great market potential and application foreground.

The SiC wafer has good material characteristics in voltage resistance, good heat resistance and low loss, so that it can be used as the key wafer material for making high-power electronic components. Consequently, it is becoming a global effort for increasing the processing efficiency of large-area SiC wafers, especially for those ≥4 inches in diameter.

However, since SiC is considered to be a superhard material with 9.25~9.5 in Mohs hardness scale that is only second to diamond, the process for polishing SiC wafer can easily be the bottleneck in a manufacturing process as the material removal rate (MRR) for SiC is not larger than 0.2 μm/h and thus the whole polishing process may take more than 2 hours to complete. Not to mention that the current market trend demands for large-size SiC wafers, while there are more and more six-inch fab becoming available internationally. Nevertheless, it can be expected that the larger the wafer is, the slower the polishing process will be, so that the cost for such process may sometimes accounts for more than half of the manufacture cost. Therefore, the key factor for enhancing the process efficiency is to provide a solution to solve the aforesaid bottleneck.

SUMMARY

In an embodiment, the present disclosure provides a vibration assistant polishing module, which comprises:

- a polishing disk, disposed for enabling the same to be rotatable;
- a workpiece carrier tray, for carrying a workpiece while enabling a finish surface of the workpiece to face toward the polishing disk;
- a linear guide way mechanism, composed of a slide, a guide seat and a guide rod in a manner that the slide is pivotally coupled to a surface of the workpiece carrier tray opposite to another surface where the workpiece is disposed, and is embedded in the guide seat, while enabling the guide rod to be disposed on the guide seat;
- a linkage, having a first end and an opposite second end while allowing the first end to be pivotally coupled to the slide;
- a motor, having a power shaft; and
- an adjustable eccentricity mechanism, further comprising: a base which is connected to the power shaft of the motor, and is coupled to the second end of the linkage via a pivot shaft while allowing the pivot shaft to be eccentrically disposed to the power shaft;
- wherein, the power shaft drives the base to rotate so as to bring along the linkage to swing eccentrically, power provided from the power shaft is transmitted to the slide via the linkage for enabling the slide to move linearly in a direction parallel to a first direction according to the limitation from guide seat, and thereby a low frequency vibration with horizontal radial amplitude is generated on the workpiece carrier tray, while simultaneously the low frequency vibration is generated on the surface of the workpiece which is engaged with the polishing disk.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
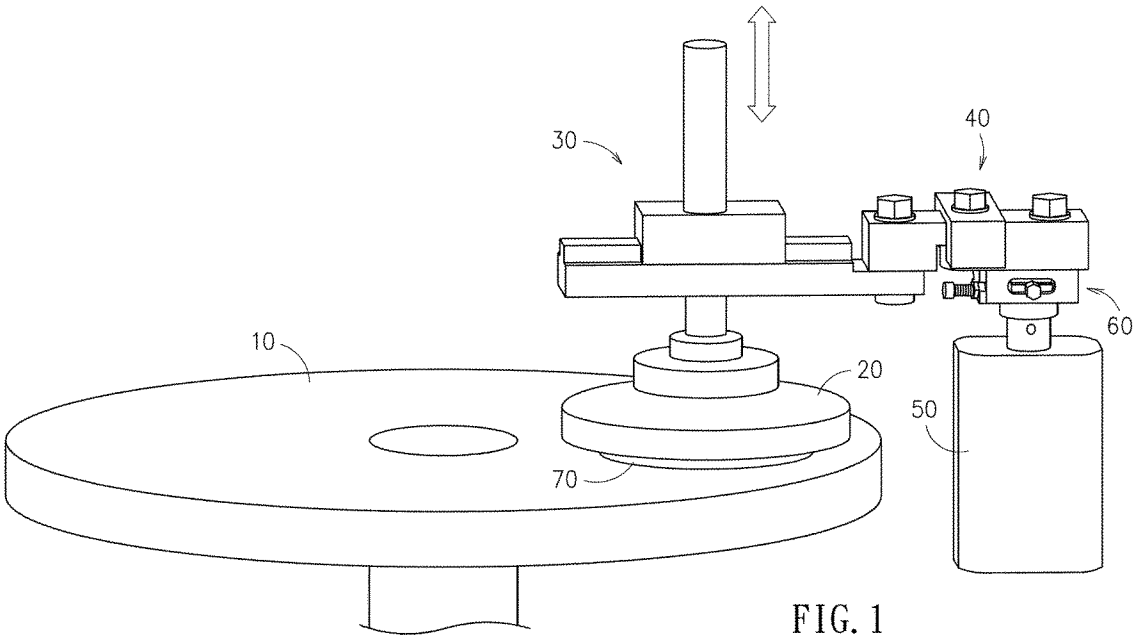
FIG. 1 is a schematic diagram showing a vibration assistant polishing module according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
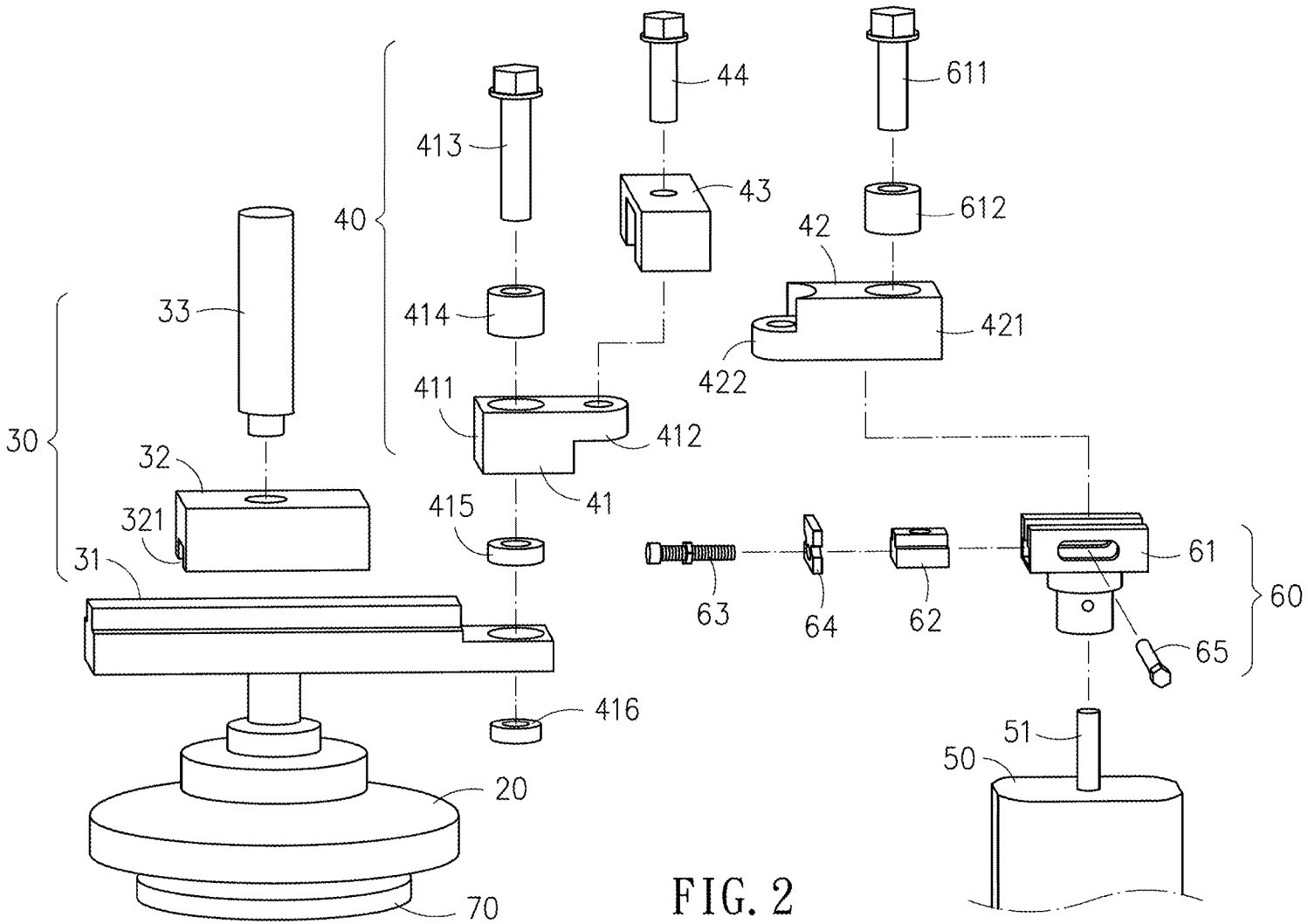
FIG. 2 is a partial exploded view of the vibration assistant polishing module of FIG. 1.

Please refer to FIG. 1 and FIG. 2, which are a schematic diagram showing a vibration assistant polishing module according to an embodiment of the present disclosure and a partial exploded view of the vibration assistant polishing module of FIG. 1. As shown in FIG. 1 and FIG. 2, a vibration assistant polishing module comprises: a polishing disk 10, a workpiece carrier tray 20, a linear guide way mechanism 30, a linkage 40, a motor 50 and an adjustable eccentricity mechanism 60.

The polishing disk 10 is disposed for enabling the same to be rotatable. The motor 50 is a modulated transmission motor, which is designed to output power via a power shaft 51. The workpiece carrier tray 20 that is provided for carrying a workpiece 70 has a fixing element to be used for fixing the workpiece 70 on the workpiece carrier tray 20 while enabling a finish surface of the workpiece 70 to face toward the polishing disk 10. It is noted that the workpiece 70 can be a hard-brittle wafer substrate that is made of a single-crystal material or a ceramic material, such as sapphire wafers or SiC wafers.

The linear guide way mechanism 30 is composed of a slide 31, a guide seat 32 and a guide rod 33 in a manner that the slide 31 is pivotally coupled to a surface of the workpiece carrier tray 20 opposite to another surface where the workpiece 70 is disposed, and is embedded in a groove 321 of the guide seat 32, while enabling the guide rod 33 to be disposed on the guide seat 32 and connected to a fixing seat. It is noted that the fixing seat is provided for restricting the guide seat 32 and the guide rod 33 from rotating freely. By the limit from the guide seat 32 to the slide 31, the slide can only move linearly along the groove 321. Moreover, the guide rod 33 is formed with a retractable part, that is provided for enabling the guide seat 32 to move up and down in synchronization with the workpiece carrier tray 20 and the workpiece 70 that are connected thereto, and thus facilitating the mounting and detaching of the workpiece 70. That is, the retractable part of the guide rod 33 drives the workpiece carrier tray 20 and the polishing disk 10 to move relative to each other for enabling the workpiece 70 to engage with or separate from the polishing disk 10.

The linkage 40 is composed of a first rod 41 and a second rod 42, while allowing an end of the first rod 41 to be a first end 411 and an end of the second rod 42 opposite to another end of the second rod 42 that is connected to the first rod 41 to be a second end 421. The first end 411 is pivotally coupled to the slide 31 via a pivot shaft 413 and bearings 414~416. The first rod 41 is formed with a first stair-like structure 412 at an end thereof provided for coupling to the second rod 42, and the second rod 42 is correspondingly formed with a second stair-like structure 422 at an end thereof provided for coupling to the first rod 41, while the first stair-like structure 412 and the second stair-like structure 422 are designed to join with each other while to be fixedly screwed together by a fixing part 43 via the screwing of a screw 44. By the operation of the first stair-like structure 412 and the second stair-like structure 422, in a condition when the screw 44 and the fixing part 43 are relieved and the retractable part of the guide rod 33 is enabled to drive the workpiece carry tray 20 to move upward and thus detach from the engagement with the polishing disk 10, the first rod 41 can be driven to move upward in synchronization with the upward-moving workpiece carry tray 20 and thus detach from the engagement with the second rod 42.

Figure 3:
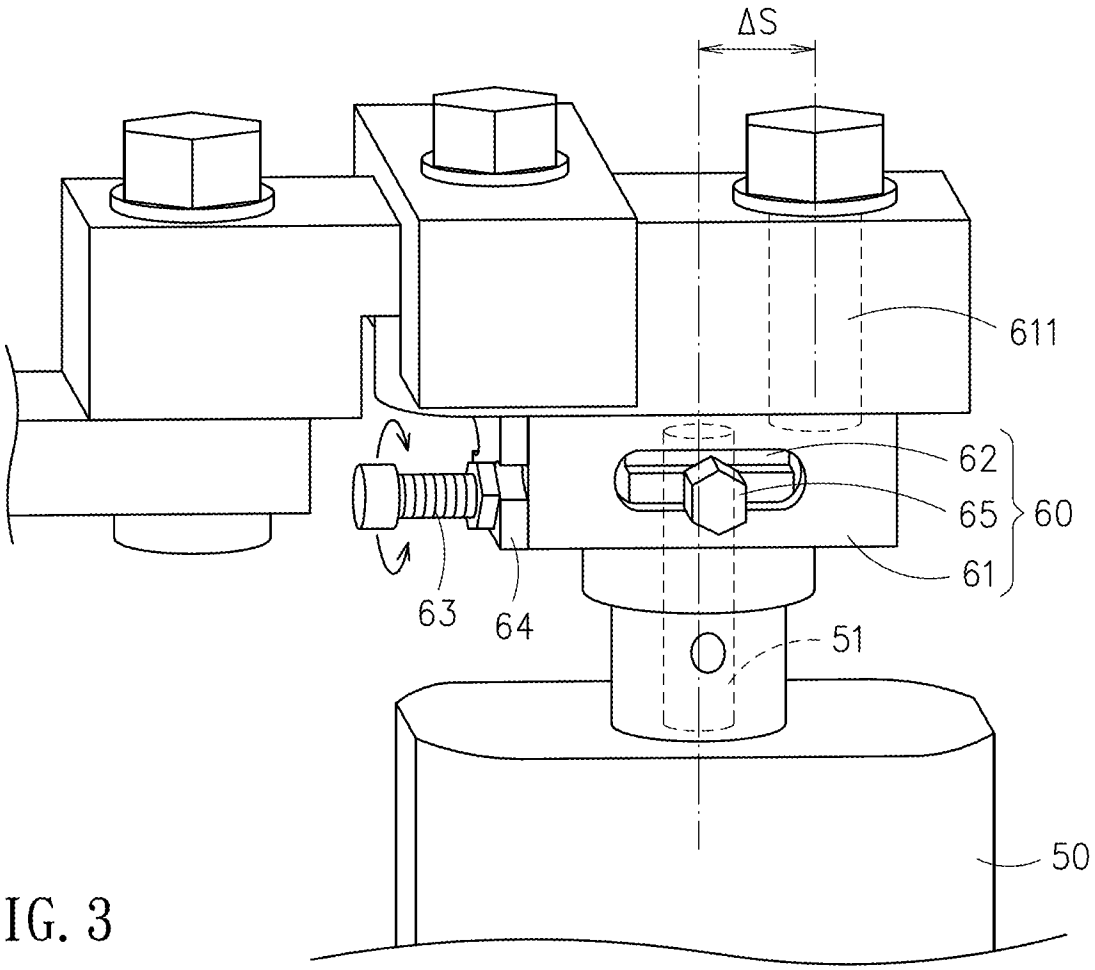
FIG. 3 is a schematic diagram showing an adjustable eccentricity mechanism used in the vibration assistant polishing module of FIG. 1.

In FIG. 2 and FIG. 3, the adjustable eccentricity mechanism 60 further comprises: a base 60, a slide block 62 and an adjustable screw 63. The base 60 is connected to the power shaft 51, and is coupled to the second end 421 of the linkage 40 via a pivot shaft 611 and a bearing 612 while allowing the pivot shaft 611 to be eccentrically disposed to the power shaft 51 by an eccentricity ΔS. The slide block 62 is disposed inside the base 61 and is provided for the power shaft 51 to piece therethrough while allowing the slide block 62 to be sealed inside the base 61 by a cap 64. The adjusting screw 63 is screwed to the slide block 62 for driving the slide block 62 to displace along an axis direction of the adjusting screw 63 by the rotating of the adjusting screw 63, and thus adjusting an eccentricity ΔS. In addition, the base 61 further has a fixing screw 65, and the fixing screw 65 is disposed screwing to the base 61 and engaging to the slide block 62 for fixing the slide block 62 at a specific position. It is noted that the eccentricity ΔS can be adjusted at will without limit, and in this embodiment it is adjustable in a range of ±5 mm.

Figure 4:
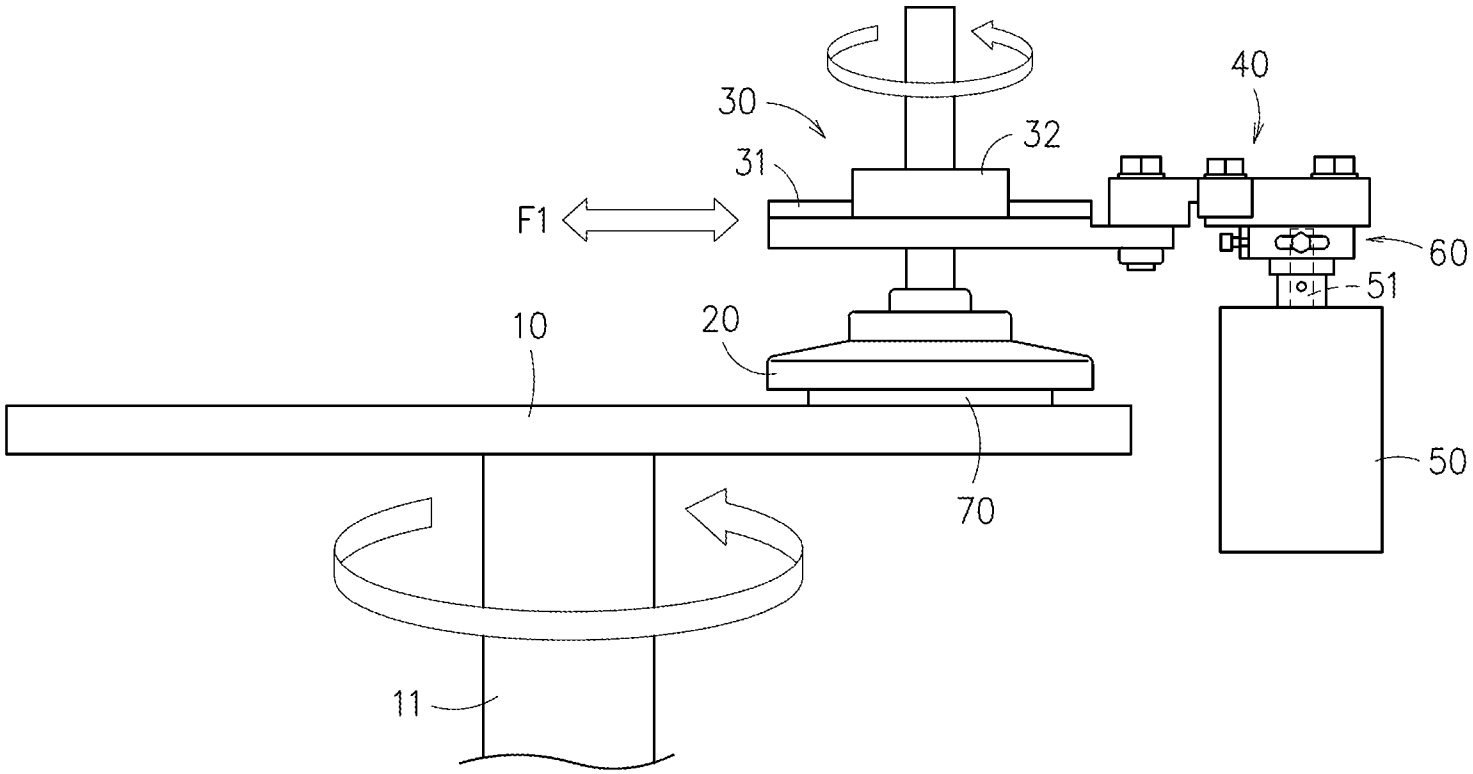
FIG. 4 is a front view of an operating vibration assistant polishing module of the present disclosure.
Figure 5:
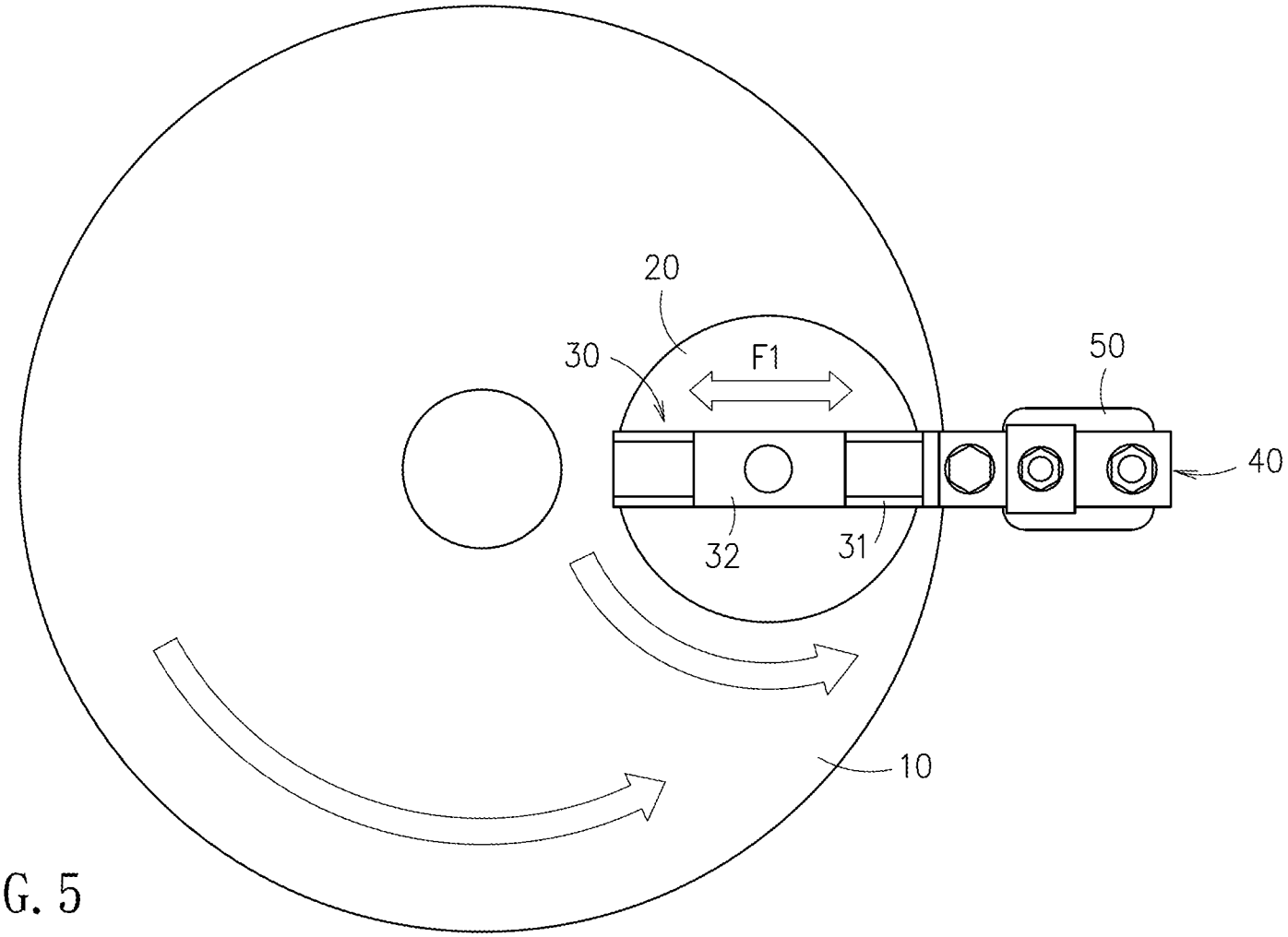
FIG. 5 is a top view of an operating vibration assistant polishing module of the present disclosure.

As shown in FIG. 4 and FIG. 5, by the operation of the adjustable eccentricity mechanism 60 and the linear guide way mechanism 30, the rotation motion of the motor 50 can be transformed into a linear motion for driving the workpiece carry tray 20 to generate a low-frequency vibration of a specific amplitude between the finish surface of the workpiece 70 and the polishing disk 10, whereas the vibration direction is defined and guided by the guide seat 32 in a radial direction of the polishing disk 10. In this embodiment, the polishing disk 10 and the workpiece 70 are both rotating in a counterclockwise direction, and the workpiece 70 is enabled to vibrate horizontally in a radial direction. Specifically, when the workpiece 70 is engaging with the polishing disk 10, the rotating polishing disk 10 can drive the workpiece 70 along with the workpiece carry tray 20 to rotate by the friction between the workpiece 70 and the polishing disk 10. Simultaneously, the motor 50 drives the base 61 to rotation via the power shaft 51 and thus brings along the linkage 40 to swing eccentrically, so that the power from the power shaft 51 is transmitted to the slide 31 via the linkage 40, and then the slide 31 is driven to move linearly in a direction parallel to a first direction F1 according to the limitation from guide seat 32, and thereby a low frequency vibration with a horizontal radial amplitude is generated on the workpiece carrier tray 2, while simultaneously a low frequency vibration is generated on the surface of the workpiece 70 which is engaged with the polishing disk 10. The first direction F1 is a direction perpendicular to and passing through a rotated center axis 11 of the polishing disk 10. In addition, since the eccentricity ΔS is adjustable in a range of ±5 mm in this embodiment, the horizontal radial amplitude is adjustable with in a range of ±0.1 mm~±10 mm, and the frequency of the horizontal radial vibration is adjustable within a range of 0.1~10 Hz according to the rotation speed of the motor 50.

Please refer to FIG. 6~FIG. 9, which are schematic diagrams showing the generation of a low frequency vibration by the cooperative operation of an adjustable eccentricity mechanism and a linear guide way mechanism in the present disclosure.

Figure 8:
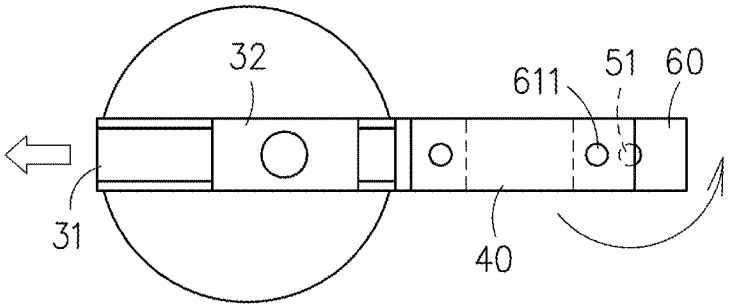
FIG. 6~FIG. 9 are schematic diagrams showing the generation of a low frequency vibration by the cooperative operation of an adjustable eccentricity mechanism and a linear guide way mechanism in the present disclosure.
Figure 9:
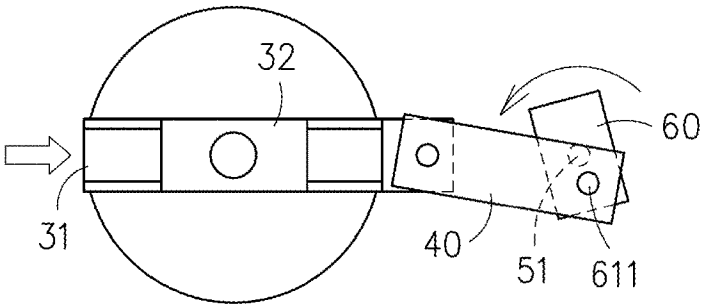
Figure 6:
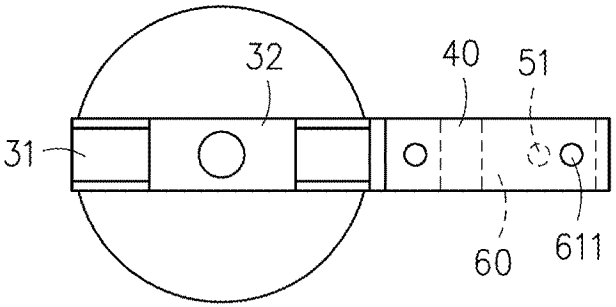
Figure 7:
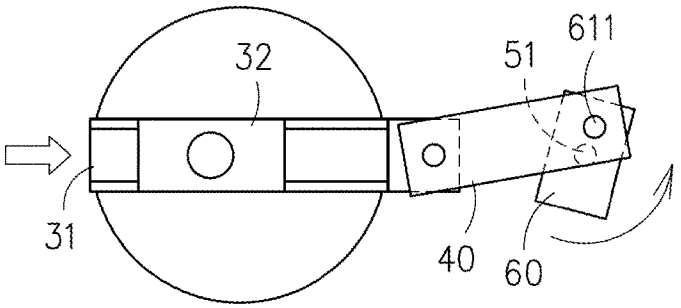

In FIG. 6, the power shaft 51 and the pivot shaft 611 are eccentrically disposed. Thereby, when the power shaft 51 is rotating, the adjustable eccentricity mechanism 60 is driven to rotate eccentrically, and thus bringing along the linkage 40 to rotate for driving slide 31 to perform a linear movement, as shown in FIG. 7. In FIG. 8, as the power shaft 51 is kept rotating, the slide 31 is being pushed to move outwardly. In FIG. 9, as the power shaft 51 is further kept rotating, the slide 31 is being pull back to its origin position that is shown in FIG. 6 for another repetition. It is noted that during the aforesaid movement, the positions of the power shaft 51 and the guide seat 32 remain unchanged, while the pivot shaft 611 will be driven to rotate about the power shaft 51.

Operationally, a liquid polishing agent can be added into a polishing process with a specific pressing load for allowing the grinding particles in the liquid polishing agent to engage with the finish surface of the workpiece duration the aforesaid vibration, and then the finish surface can be cut, grinded, and polished. Since there are sideway impacts occurred during the aforesaid vibration, not only the deteriorative layer of the workpiece can be removed, but also the debris of the polishing process can be expelled. By the wave propagation of the aforesaid vibration, the movement of the grinding particles in the liquid polishing agent that was randomly distribution is enhanced, so that the effective grains number in the polishing process is increased and thus the material removal rate is increased. That is, by the vibration induced by the vibration assistant polishing module of the present disclosure, the working area of the workpiece is increased as the effective grains number in the polishing process is increased, and thus the material removal rate is increased.

Figure 10:
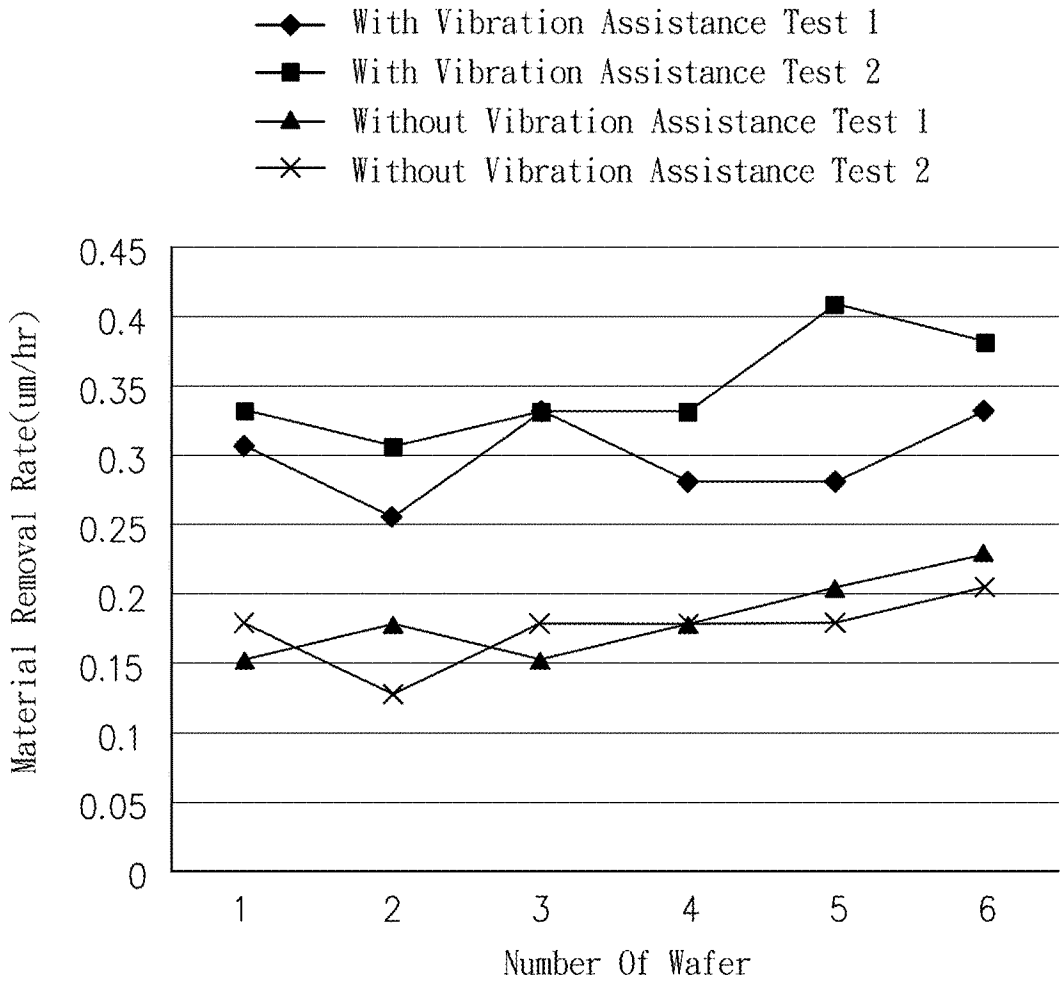
FIG. 10 is a curve diagram showing a comparison of process efficiency between those with the vibration assistant polishing module of the present disclosure and those without.

Please refer to FIG. 10, which is a curve diagram showing a comparison of process efficiency between those with the vibration assistant polishing module of the present disclosure and those without. In this embodiment, a 2-inch sapphire wafer is used in a polishing process for obtaining a comparison of process efficiency between those with the vibration assistant polishing module of the present disclosure and those without. The comparison shown in FIG. 10 is performed under the flowing conditions: a motor capable of rotating under 500 RPM is used for generating a vibration of 1~5 Hz via an adjustable eccentricity mechanism; the process pressure is 500 g/cm$^2$; the rotation speed of the polishing disk is 40 rpm; the grinding particles are diamond particles of 3 μm in diameter; and the vibration frequency is 2.5 Hz and the vibration amplitude is ±5 mm. It is noted that the experiment 2 of FIG. 10 is a repetition of the experiment 1. From the experiments of FIG. 10, the wafer can be polished effectively and rapidly by the assistance of the vibration assistant polishing module of the present disclosure, whereas the removal rate of the wafer polishing can reach higher than 0.35 μm/hr, that is increased by about 50~100%. That is, the process efficiency is increased by 1~2 times, and thus the effectiveness of the vibration assistant polishing module of the present disclosure can be proven.

To sum up, the vibration assistant polishing module of the present disclosure is provided for converting a rotation of the a rotation device into a linear vibration motion in a radial direction that is used for driving a polishing platform to vibrate periodically, and further, optimizing the matching between the vibration frequency and the rotation speed of the polishing platform. In the present disclosure, the workpiece, that can be a hard-brittle substrate, is disposed above the polishing disk for allowing the adjustable eccentricity mechanism to enable a low-frequency vibration on the workpiece while the polishing disk is being driven to rotate, so that a vibration assisted polishing process can be enabled for large-area polishing, that is different from those conventional ultrasonic vibration enabled by piezoelectric materials or other conventional processes combining a simple rotation movement with a linear motion. Furthermore, the vibration assistant polishing module of the present disclosure adopts a modularized design that can be applied and added easily on any conventional polishing apparatuses. Thereby, the process efficiency can be increased at a lower cost. Consequently, not only the low material removal rate for polishing hard-brittle substrate can be improved and the reliability and production of the vibration platform are enhanced, but also the manufacturing cost is decreased by the improved structural simplicity of the vibration platform.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A vibration assistant polishing module, adapted for polishing a workpiece, comprising:

a polishing disk, disposed for enabling the same to be rotatable;

a workpiece carrier tray, for carrying the workpiece while enabling a finish surface of the workpiece to face toward the polishing disk;

a linear guide way mechanism, composed of a slide, a guide seat and a guide rod in a manner that the slide is pivotally coupled to a surface of the workpiece carrier tray opposite to another surface where the workpiece is disposed, and is embedded in the guide seat, while enabling the guide rod to be disposed on the guide seat;

a linkage, having a first end and an opposite second end while allowing the first end to be pivotally coupled to the slide;

a motor, having a power shaft; and an adjustable eccentricity mechanism, further comprising: a base which is connected to the power shaft of the motor, and is coupled to the second end of the linkage via a pivot shaft while allowing the pivot shaft to be eccentrically disposed to the power shaft;

wherein, the power shaft drives the base to rotate so as to bring along the linkage to swing eccentrically, power provided from the power shaft is transmitted to the slide via the linkage for enabling the slide to move linearly in a direction parallel to a first direction according to a limitation from guide seat, and thereby a low frequency vibration with a horizontal radial amplitude is generated on the workpiece carrier tray, while simultaneously the low frequency vibration is generated on the surface of the workpiece which is engaged with the polishing disk.

2. The vibration assistant polishing module of claim 1, wherein the adjustable eccentricity mechanism further comprises:

a slide block, disposed inside the base and provided for the power shaft to piece therethrough; and an adjusting screw, screwed to the slide block for driving the slide block to displace along an axis direction of the adjusting screw by the rotating of the adjusting screw, and thus adjusting an eccentricity between axes of the pivot shaft and the power shaft.

3. The vibration assistant polishing module of claim 2, wherein the base further has a fixing screw, and the fixing screw is disposed screwing to the base and engaging to the slide block for fixing the slide block at a specific position.

4. The vibration assistant polishing module of claim 1, wherein the linkage is composed of a first rod and a second rod, while allowing the first end to be an end of the first rod and the second end to be an end of the second rod opposite to another end of the second rod that is connected to the first rod; the first rod is formed with a first stair-like structure at an end thereof provided for coupling to the second rod, and the second rod is correspondingly formed with a second stair-like structure at an end thereof provided for coupling to the first rod, while the first stair-like structure and the second stair-like structure are designed to join with each other.

5. The vibration assistant polishing module of claim 4, wherein when the workpiece carrier tray is driven to detach from the polishing disk, the first rod is enabled to move in synchronization with the movement of the polishing disk and detach from engaging to the second rod.

6. The vibration assistant polishing module of claim 1, wherein the horizontal radial amplitude is adjustable with in a range of ±0.1mm~±10mm.

7. The vibration assistant polishing module of claim 1, wherein the frequency of the horizontal radial vibration is adjustable within a range of 0.1~10 Hz.

8. The vibration assistant polishing module of claim 1, wherein the first direction is a direction perpendicular to and passing through a rotated center axis of the polishing disk.

9. The vibration assistant polishing module of claim 1, wherein the workpiece is substantially a wafer substrate.

* * * * *